US011466956B2

(12) United States Patent
Puffe et al.

(10) Patent No.: US 11,466,956 B2
(45) Date of Patent: Oct. 11, 2022

(54) BOW CRUTCH

(71) Applicant: Allwear Products LLC, Meridian, ID (US)

(72) Inventors: Zachariah Clemente Puffe, Nampa, ID (US); Corey James Miller, Meridian, ID (US)

( * ) Notice: Subject to any disclaimer, the term of this patent is extended or adjusted under 35 U.S.C. 154(b) by 0 days.

(21) Appl. No.: 17/002,747

(22) Filed: Aug. 25, 2020

(65) Prior Publication Data

US 2021/0055073 A1 Feb. 25, 2021

Related U.S. Application Data

(60) Provisional application No. 62/890,164, filed on Aug. 22, 2019.

(51) Int. Cl.
*F41B 5/20* (2006.01)
*F41B 5/14* (2006.01)

(52) U.S. Cl.
CPC ..... *F41B 5/1426* (2013.01); *F41B 5/1453* (2013.01)

(58) Field of Classification Search
CPC ..... F41B 5/14; F41B 5/1426; F41B 5/1453
USPC ..... 124/88, 89
See application file for complete search history.

(56) References Cited

U.S. PATENT DOCUMENTS 4,054,121 A * 10/1977 Hoyt, Jr. ..... F41B 5/1426 124/88
4,329,972 A * 5/1982 Wilson ..... F41B 5/1469 124/24.1
4,343,286 A * 8/1982 Thacker ..... F41B 5/143 124/44.5
4,662,344 A * 5/1987 Mitchell ..... F41B 3/02 124/24.1
4,674,472 A * 6/1987 Reis ..... F16M 11/046 273/DIG. 19
4,787,361 A * 11/1988 Vyprachticky ..... F41B 5/14 124/24.1
4,836,177 A * 6/1989 Williams ..... F41B 5/14 124/88
5,103,798 A * 4/1992 McGraw ..... F41B 5/14 124/88
5,137,008 A * 8/1992 Taylor ..... F41B 5/14 124/88
5,205,272 A * 4/1993 Boyer ..... F41B 5/1426 248/688
5,320,085 A * 6/1994 Hanneman ..... F41B 5/14 124/89

(Continued)

*Primary Examiner* — Alexander R Niconovich
(74) *Attorney, Agent, or Firm* — Scott D. Swanson; Shaver & Swanson, LLP

(57) ABSTRACT

An attachment for a compound bow that allows for improved carrying of the compound bow when a user has the bow in a non-shooting position. The attachment attaches to the compound bow at the threaded stabilizer receiver. The attachment can be attached to a stabilizer, or alternatively can have an extension that directly threads to the stabilizer receiver of the compound bow. The attachment can clip to a standard receiver, or alternatively can be threaded to an end of the stabilizer. The attachment can be configured such that a counterbalance weight can be attached to the attachment. The attachment is generally in a U shape or similar shape that allows for the arm or hand of a user to be positioned within the attachment.

15 Claims, 8 Drawing Sheets

(56) References Cited

U.S. PATENT DOCUMENTS 5,349,937 A * 9/1994 Burling ..... F41B 5/1438 124/86
5,464,002 A * 11/1995 Lavoie ..... F41B 5/14 124/23.1
5,509,400 A * 4/1996 Chalin ..... F41B 5/14 124/88
5,522,376 A * 6/1996 Collinsworth ..... F41B 5/1461 D22/107
5,531,211 A * 7/1996 Wilfong, Jr. ..... F41B 5/14 124/88
5,547,162 A * 8/1996 Sobolewski ..... F41B 5/14 248/688
5,619,981 A * 4/1997 Breedlove ..... F41B 5/1426 248/156
5,853,000 A * 12/1998 Torgerson ..... F41B 5/14 124/88
6,070,569 A * 6/2000 Chalin ..... F41B 5/14 124/88
6,173,707 B1 * 1/2001 Howell ..... F41B 5/14 124/88
6,205,992 B1 * 3/2001 Meeks ..... F41B 5/14 248/169
6,561,477 B1 * 5/2003 Prive ..... F41B 5/14 248/339
6,745,756 B1 * 6/2004 Achkar ..... F41B 5/1461 124/88
6,802,307 B2 * 10/2004 Leven ..... F16F 7/108 124/89
7,152,595 B1 * 12/2006 Muhich ..... F41B 5/14 124/23.1
7,849,846 B1 * 12/2010 Boucher ..... F41B 5/14 124/88
7,954,481 B2 * 6/2011 Barnard ..... F41B 5/1426 124/90
8,225,778 B2 * 7/2012 Walk ..... F41B 5/143 124/89
8,347,870 B1 * 1/2013 Mahutga ..... F41B 5/1426 124/89
8,627,813 B1 * 1/2014 Close ..... F41B 5/148 124/88
8,646,440 B1 * 2/2014 Albanese ..... F41B 5/1426 124/88
8,662,064 B1 * 3/2014 Campbell ..... F41B 5/1426 124/88
8,695,580 B2 * 4/2014 LoRocco ..... F41B 5/1426 124/89
8,776,772 B1 * 7/2014 Albanese ..... F41B 5/1426 124/88
8,783,238 B2 * 7/2014 Julian ..... F41B 5/1426 124/89
8,955,504 B1 * 2/2015 Albanese ..... F41B 5/1426 124/88
9,038,618 B1 * 5/2015 Bomar ..... F41B 5/1426 124/88
9,163,896 B2 * 10/2015 Jacobs ..... F41B 5/14
9,372,046 B2 * 6/2016 Albanese ..... F41B 5/14
9,915,494 B2 * 3/2018 Potts ..... F41B 5/1426
10,907,926 B1 * 2/2021 Alba ..... F41B 5/1426
2010/0031946 A1 * 2/2010 LoRocco ..... F41B 5/1426 124/89
2012/0174904 A1 * 7/2012 Greenhoe ..... F41B 5/1426 124/89
2013/0263839 A1 * 10/2013 Dominski ..... F41B 5/1426 124/23.1
2015/0013658 A1 * 1/2015 Gibson ..... F41B 5/148 124/88
2015/0144119 A1 * 5/2015 Arajakis ..... F41B 5/1426 124/88
2015/0345892 A1 * 12/2015 Stokes ..... F41B 5/1426 124/89
2017/0160043 A1 * 6/2017 Potts ..... F41B 5/1426

* cited by examiner

BOW CRUTCH

PRIORITY/CROSS-REFERENCE TO RELATED APPLICATIONS

This application claims the benefit of U.S. Provisional Application No. 62/890,164, filed Aug. 22, 2019, the disclosure of which is incorporated by reference.

TECHNICAL FIELD

The apparatus described relates generally to an attachment to a compound bow for the purpose of ease of transport of the bow while in the field. A bow may be bulky and heavy after a certain amount of travel while in transition. Bows may weigh up to 8 pounds with all the components attached, which makes toting this awkward weight in the field demanding at times. A sling may be used to support the bow in the field, but takes time to remove, and may deny the hunter the opportunity of a lifetime.

BACKGROUND

A compound archery bow typically includes a pair of pulleys, with at least one of the pulleys having a cam surface to provide a mechanical advantage while drawing the bow. Bow technology has changed drastically during the last decade, to the extent that every year archers flock to Pro Shops to try the lasted new technology that may make them a better shot. One item that has evolved through the years is the stabilizer bar. The stabilizer bar counter acts the weight of the bow, and absorbs the vibration after the release of the bowstring. While in the field, a hunter may travel many miles in search of an ungulate. Not only does the hunter wear heavy clothing, but also carries a pack filled with necessary items that may weigh up to 70 pounds. While walking in the mountains with all the equipment, the hunter is constantly moving the compound bow to one hand or the other, also positioning the bow to relieve the strain from the previous position. One bow carrying position utilized by bowhunters is to grasp the handle of the bow from the opposite direction of when the user is shooting the bow. In this position, if the bow is attached with a wrist bow sling and/or stabilizer, the wrist bow sling and/or stabilizer serve to distribute some weight to the arm of the bow hunter, relieving some weight from the bow hunter's hand, but this is still not an optimal mechanism. What is needed is an improved mechanism to tote the bow while increasing comfort to the user's hands while toting the bow in the field.

BRIEF SUMMARY OF THE INVENTION

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

The embodiments described in this disclosure enable an archer to tote a compound bow deeper into the woods without causing unnecessary torque on the wrist of the hunter.

Most compound bows have a stabilizer bar for the purpose of counterweight, and for minimizing vibration of the bow after the release of the bowstring. Adding an apparatus to the stabilizer bar for the purpose of balancing the bow between the handle and the wrist will greatly release the torque; hence, allowing the hunter to travel a greater distance while in the field. The bow crutch can locate anywhere between the fingertip(s) to shoulder of a human body. Embodiments of the bow crutch may be in a "U" shape or any geometric shape to facilitate any part of the hand or arm.

All compound bows come with a threaded hole in the riser to facilitate a stabilizer bar. Some archers do not use stabilizer bars because of weight and awkwardness while in route. Embodiments of the bow-crutch may standalone and attach to the threaded hole in the riser instead of attaching to the stabilizer bar.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION

Figure 1:
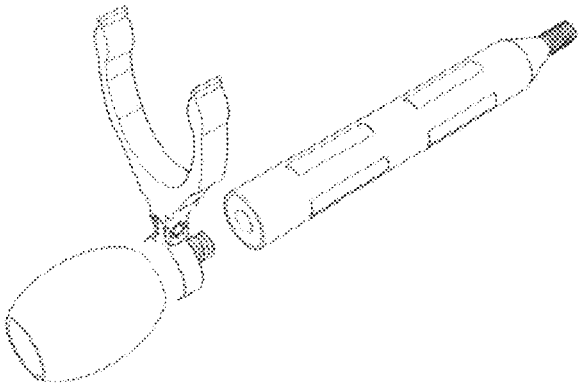
FIG. 1 is an isometric perspective showing an embodiment of an archery stabilizer bar attached to an arm support.

While the presently disclosed technology is susceptible of various modifications and alternative constructions, certain illustrated embodiments thereof have been shown in the drawings and will be described below in detail. It should be understood, however, that there is no intention to limit the claimed technology to the specific form disclosed, but, on the contrary, the presently disclosed and claimed technology is to cover all modifications, alternative constructions, and equivalents falling within the spirit and scope of the inventive concept(s) as defined in the claims that are issued from any nonprovisional that claims benefit of the material disclosed herein.

FIG. 1 depicts a parted stabilizer bar with a main body, 114, and weight attachment 112. A threaded distal end, 110, attaches to the riser of bow. Most bows have a stabilizer bar for purposes of stabilizing the recoil, and for removing a large portion of the shock at the handle. A weight, 112 with a threaded male, 100, at the distal end (or first end), is received by the internal threaded end, 102 at the proximal end (or second end) of the stabilizer, 114. A washer or ring embodiment, 108, is fitted between the proximal weight, 112, and stabilizer body, 114. When proximal weight, 112, and stabilizer bar, 114 are attached by external thread, 100, on a post of said weight, and internal thread, 102, the ring, 108, is compressed securely. Attached to the ring, 108, is an incremental adjuster, 106, for the purpose of positioning the support arm, 104, to the desired position. It may be noted that the incremental adjustment mechanism, 106, is optional depending on the embodiment of the invention. In use the holder of the bow rotates the bow about 180 degrees from the shooting position to grasp bow by the front of the handle. The user's arm or wrist is positioned into the valley of the U-shaped support arm, thus allowing the user to lean carry the bow such that some of the weight of the bow is on the user's arm or wrist, as opposed to fully on the user's hand.

Figure 2:
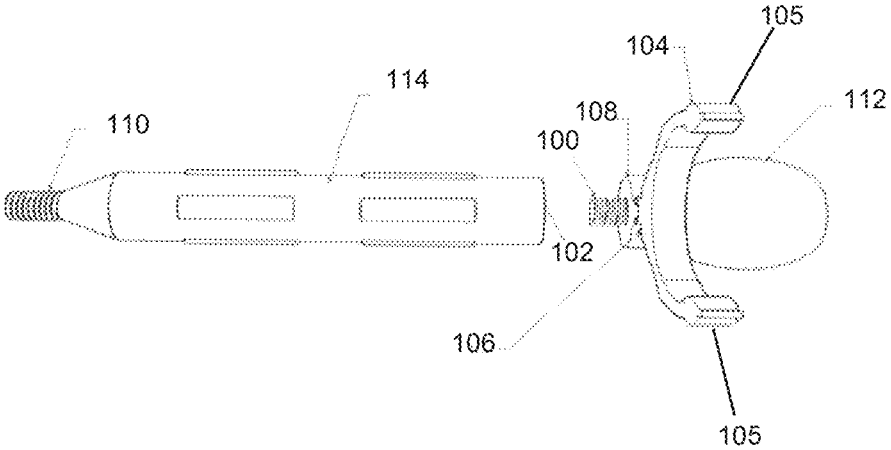
FIG. 2 is a top view perspective showing an embodiment of an archery stabilizer bar attached to a support of FIG. 1.
Figure 8:
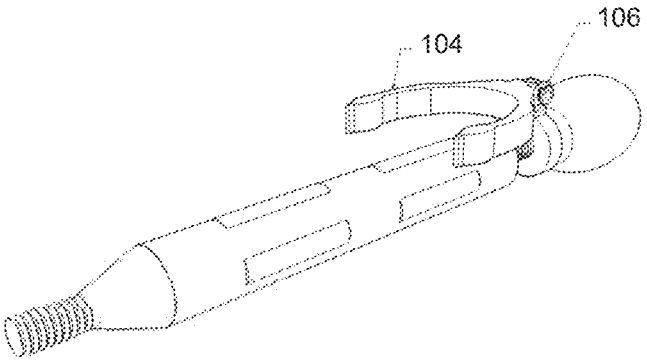
FIG. 8 is an isometric view of the stabilizer bar and arm support of FIG. 1 with the arm support relaxed in the down position.

FIG. 2 depicts the top view to the stabilizer body, 114 and the proximal weight, 112. The stabilizer body, or extension arm, defines a longitudinal axis L that extends away from the bow. As illustrated, the threaded end, 110, of the stabilizer bar, 114, threads on, (or attaches) to the riser of the bow. The proximal weight, 112, attaches to the stabilizer, 114, via thread, 100, located at the distal end of proximal end of weight, 112. The threaded, 100, distal end of weight, 112, attaches to proximal end, 102, of the stabilizer bar, 114. A ring, 108, locates on the peripheral of the thread, 100, and becomes secured by tightening the proximal weight, 112, to the internal thread, 102, located at the proximal end of the stabilizer bar, 114. Attached to the ring, 108, is an incremental mechanical apparatus, 106, for the purpose of adjusting the support arm, 104, to any specific rotation. The arm support 104 provides a U-shape having two opposing arms 105 extending perpendicularly, illustrated by the line P, to the longitudinal axis of the extension arm. It may be noted that the arm support, 104, may not need an incremental mechanical device, 106, for purposes of rotation. The support arm, 104, in laying position, FIG. 8, is best served while in the bow case.

Figure 3:
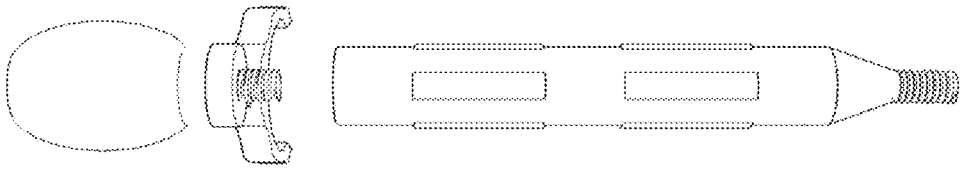
FIG. 3 is a bottom view of the stabilizer bar and arm support of FIG. 1.

FIG. 3 shows the bottom view of the stabilizer bar, 114, the threaded distal end, 110, and the internal threaded hole, 102, at the proximal end of the stabilizer bar, 114. Exploded view of the stabilizer bar, 114, and proximal weight, 112, with threaded end, 100. A ring, 108, is located around the thread end, 100. Located on the ring, 108, is an incremental adjuster, 106, for the purpose of adjusting the support arm, 104, to the desired position.

Figure 4:
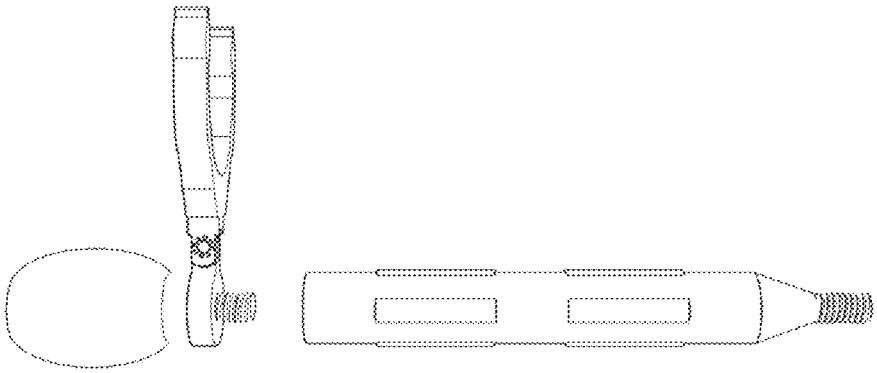
FIG. 4 is the back view of the stabilizer bar and arm support of FIG. 1.

FIG. 4 depicts the back view of the stabilizer bar, 114, with the threads, 110, that attaches to the riser of the bow. The proximal weight, 112, is attached to the embodiment of the stabilizer bar, 114. A ring, 108, is located between the proximal weight, 112, and the stabilizer bar, 114. Attached to the ring, 108, is an incremental mechanism, 106 for quick rotational adjustment. A support arm, 104, is held in place via an incremental methodology, 106, or simply by a dial or wingnut to adjust tension between the support arm, 104, and the ring, 108, that is located between the proximal weight, 112, and the stabilizer bar, 114.

Figure 5:
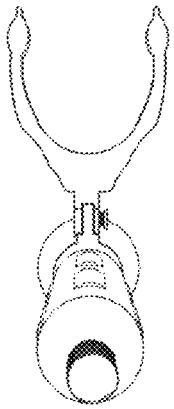
FIG. 5 is a front view of the stabilizer bar and arm support of FIG. 1.

FIG. 5 illustrates the front view of the stabilizer bar, 114, the proximal weight, 112, the incremental adjuster, 106, and the support arm, 104.

Figure 6:
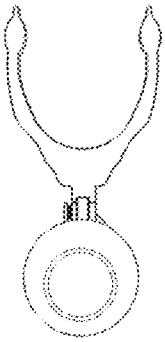
FIG. 6 is a right-angle perspective of the stabilizer bar and arm support of FIG. 1.

FIG. 6 depicts the right-side view of the stabilizer bar, 114, the distal thread, 110, of the stabilizer bar, 114, which attaches to the riser of the bow. Located at the proximal end is a weight, 112; and at the distal end of weight, 112, is an external thread, 100. Fitted around the thread, 100, is a ring, 108. Attached to the ring, 108, is a support arm, 104, with an incremental mechanical device, 106, for the purpose of incrementally transitioning the support arm, 104, to the desired rotation.

Figure 7:
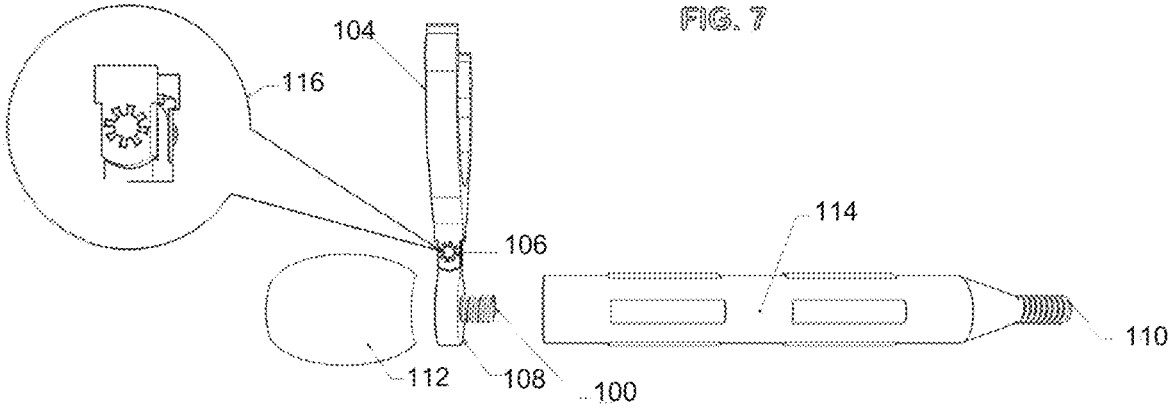
FIG. 7 is a left-angle perspective of the stabilizer bar and arm support of FIG. 1 including an exploded depiction of the incremental locking mechanism of the arm crutch.

FIG. 7 depicts the left-side view of the stabilizer bar, 114, and the external thread, 110, at the distal end of the stabilizer bar, 114. Also depicted is a weight, 112, and the thread, 100, attached at the distal end of the weight, 112. A ring, 108, locates around the thread, 110, and a support arm, 104, locates on the ring, 108, with an incremental mechanical device, 106, attached thereto. No. 116, is an exploded view of 106, which is the incremental mechanical device for the purpose of rotating the support arm, 104, to the desired position.

FIG. 8 depicts an isometric view of support arm, 104, folded parallel to the stabilizer bar. An incremental adjustment mechanism, 106, may allow the support arm, 104 to rotate at any desired angle. It may be noted that the incremental device may or may not be the only means by which the rotating support arm, 104, may rotate.

Figure 9:
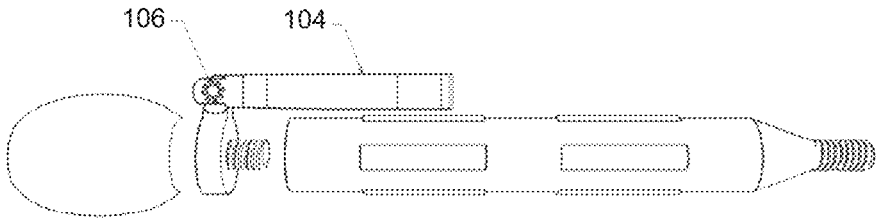
FIG. 9 is a left-angle view of a stabilizer bar with an arm support relaxed in the down position. The incremental positioning of the support arm may be transitionally static to the desired position.

FIG. 9 illustrates a left-side view of the stabilizer bar and the proximal weight. A support arm, 104 is depicted laying flat parallel to the stabilizer bar. An incremental mechanical device, 106, allow the support arm, 104, to rotate to the desired angle.

Figure 10:
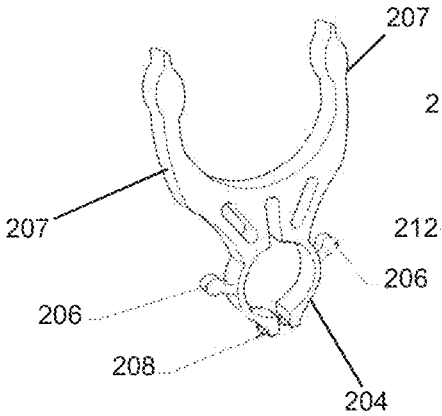
FIG. 10 is an isometric view of an embodiment of an arm supporter that attaches to a stabilizer bar and is secured by an elastomer material.

FIG. 10 depicts an attachable support arm, 204, that wraps around most standard stabilizer bars without a detachable proximal weight. The attachable support arm is provided in a U-shape having two opposing arms. Posts, 206, are located on the peripheral portion of the split ring, 208.

Figure 11:
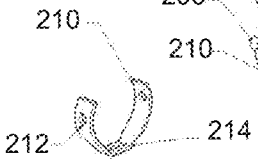
FIG. 11 is an isometric view of an elastomer material.

FIG. 11 depicts an elastomer material, 210, that has through holes, 212. Locating grooves, 214, may fit between support grooves on ring, 208, located on FIG. 10. It also may be noted that the hole(s), 212, will be supported by posts, 206 on FIG. 10. The tighter the tension of the elastic material, 210, the tighter the support arm, 204, will hold to the stabilizer bar.

Figure 12:
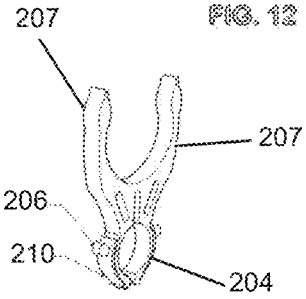
FIG. 12 is an isometric view of the arm support with an elastomer material stretched around the lower peripheral portion.
Figure 13:
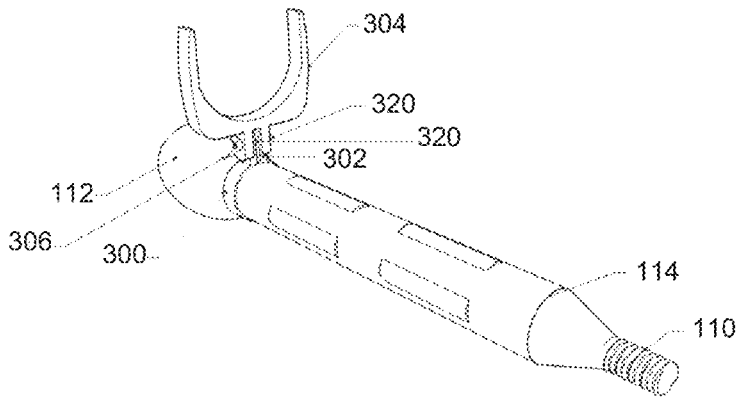
FIG. 13 is an isometric view a stabilizer bar with an arm support that encompasses the circumference of the bar, and is tightened to clamp the arm support securely thereto.

FIG. 12 is illustrative of a conjunction of FIG. 10 and FIG. 11. The support arm, 204, locates on a stabilizer bar, and is held by tension from an elastic material, 210, via posts, 206 attached to the support arm, 204. FIG. 13 is an isometric view of a threaded, 110, stabilizer bar, 114, attached to a proximal weight, 112. An external ring, 300, fits around the stabilizer bar, 114, and the distal end of the weight, 112. Attached to the ring, 300, is a splitting fork, 302, in which the ring, 300, can be split to locate onto the stabilizer bar, 114. At the base of the support arm, 304, are two parted forks, 320. Between parted forks, 320, the splitting forks, 302, that are attached to the ring, 300, may fit linearly between parted forks, 320, and may allow a bolt to pass through both forks, 320 and 302. A wingnut, 306, or dial may tighten and secure the support arm, 304, in the desired rotation by friction. The attachment mechanism displayed in FIGS. 10-12 provides an example of a clamp configured to attach the U-shaped support arm to a stabilizer.

Figure 14:
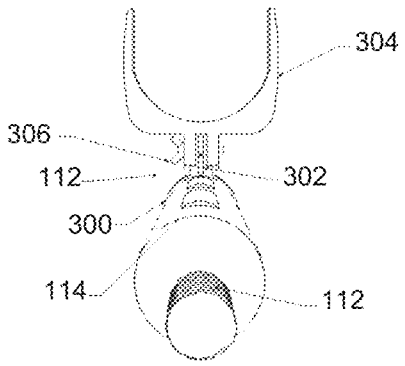
FIG. 14 is a back perspective of the stabilizer bar with the clamp to tighten arm support thereto of FIG. 13.

FIG. 14 is a back view of a stabilizer bar, 114, and a proximal weight, 112. An external thread, 110, is located at the proximal end of stabilizer bar, 114. The external ring, 300, is split at the forks, 302, in order to fit the circumference of multiple diameters of stabilizer bars. At the base of the support arm, 304, are parted forks, 320. Partible forks, 302, fit between parted forks, 320, located at the base of support arms, 304. A wingnut, 306, or dial may tighten forks, 302, and 320 together by friction; hence, holding support arm, 304, in the desired rotation.

Figure 15:
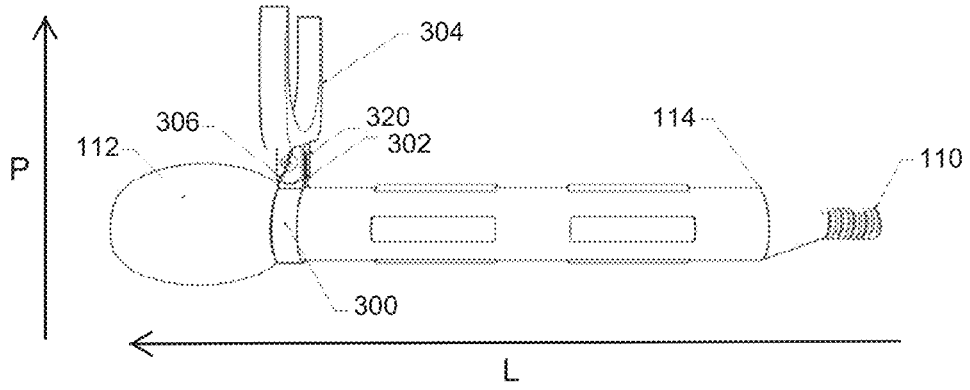
FIG. 15 is a left side view of the embodiment shown in FIG. 13.

FIG. 15 depicts a left-angle side view of the ring, 300, support arm, 304, located on the circumference of a stabilizer bar, 114. External threads, 110, will attach to the internal threads of the riser on the bow. A weight, 112, is located at the proximal end of stabilizer bar, 114. A ring, 300, spreads to fit around the circumference of a stabilizer bar, 114. The split of the forks, 320, will encompass the parted forks, 302, attached to the support arm, 304. A wingnut, 306, or dial may tighten forks, 302 and 320, together by friction. It may be noted that the ring, 300, as shown on FIG. 15, may also attach to the stabilizer bar, 114, by a washer style as shown in FIG. 1-9, by which the proximal weight, 112, and stabilizer bar, 114, will compress the ring, 108, and secure it in place. See FIG. 1-9.

Figure 16:
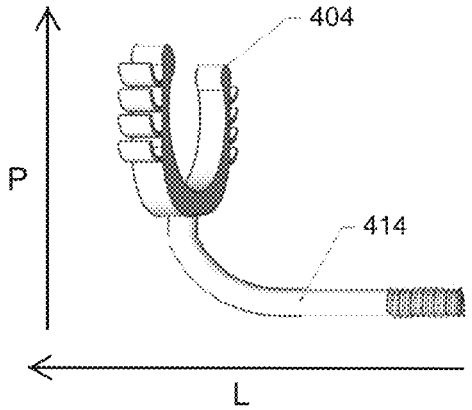
FIG. 16 is a left angle of an embodiment of an arm support apparatus that screws in or attaches to the riser of the bow.

FIG. 16 depicts a simple bar, 414, with an erect support arm, 404, that is absent of a stabilizer bar. This may attach to the riser via threads or any locking mechanism that secures FIG. 16 to a riser or any part of a bow. The support arm, 404 may be solely erect (or integral with the bar), or pivotable on the bar or extension arm, 414.

Figure 17:
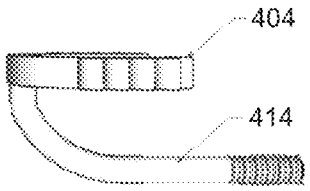
FIG. 17 is a left angle of an embodiment of an arm support apparatus in a relaxed position that screws in or attaches to the riser of the bow.

FIG. 17 depicts a simple bar, 414, with a support arm, 404, laid down parallel to the bar, 414. The support arm, 404 is a pivotable arm, 404, for the purpose of locating the support arm, 404, to the optimal orientation.

Figure 18:
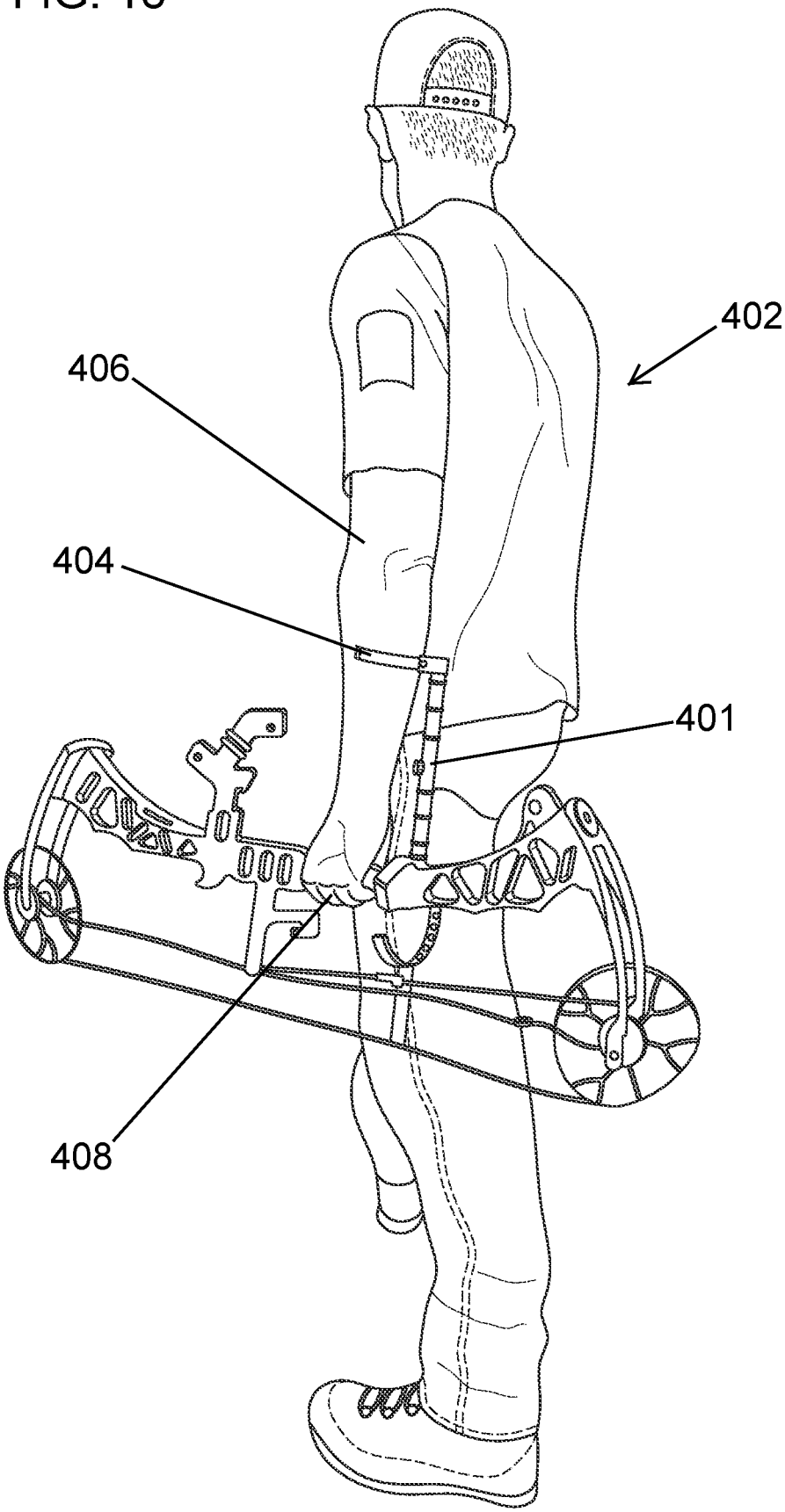
FIG. 18 is an illustration of a bow user utilizing an embodiment of a bow crutch with the u-shaped section of the bow crutch positioned against the user's forearm.

FIG. 18 depicts a bow user 402 utilizing an embodiment of the bow crutch 401 to provide support or lean the bow against the user's arm 406 between the elbow and the user's wrist in the u-shaped support arm 404. The user's hand 408 is grasping the grip of the bow.

While certain exemplary embodiments are shown in the Figures and described in this disclosure, it is to be distinctly understood that the presently disclosed inventive concept(s) is not limited thereto but may be variously embodied to practice within the scope of this disclosure. From the foregoing description, it will be apparent that various changes may be made without departing from the spirit and scope of the disclosure as defined herein.

I claim:

1. A compound bow attachment, said compound bow attachment comprising:

an extension arm comprising a threaded first end and a second end, wherein said first end is configured for threaded attachment to an archery compound bow having a bow frame and a bow string and a threaded opening for a stabilizer attachment such that said extension arm threaded first end attaches to said threaded opening for a stabilizer attachment such that said extension arm extends forward from the bow frame and on an opposite side of the bow frame from away from the bow string, wherein said extension arm defines an extension arm longitudinal axis; and a u-shaped support arm comprising a valley and two opposing arms and configured to receive a human forearm to provide support between said human forearm to a compound bow to which said compound bow attachment is attached, wherein said u-shaped support arm is positioned at said second end of said extension arm, wherein said u-shaped support arm extends perpendicular to said extension arm longitudinal axis such that said opposing arms of said u-shaped support arm extend in a perpendicular direction to said extension arm longitudinal axis such that said u-shaped support arm is configured to extend around a user's forearm such that the user's forearm is positioned in the valley of the u-shaped support arm when the user grasps a grip of the compound bow in an opposite orientation to the bow string of the compound bow to which the compound bow attachment is attached.

2. The compound bow attachment of claim 1, wherein said u-shaped support arm is pivotally connected to said extension arm to allow for pivotal adjustment of said u-shaped support arm relative to said extension arm.

3. The compound bow attachment of claim 2, wherein said u-shaped support arm is pivotally connected to said extension arm by an incremental adjuster.

4. The compound bow attachment of claim 3, wherein said incremental adjuster is positioned between said u-shaped support arm and said extension arm and configured for pivotal adjustment of said u-shaped support arm relative to said extension arm.

5. The compound bow attachment of claim 3, wherein said incremental adjuster comprises a dial.

6. The compound bow attachment of claim 3, wherein said incremental adjuster comprises a ratchet attachment.

7. The compound bow attachment of claim 2, wherein said compound bow attachment comprises a locking mechanism configured to prevent pivotal adjustment of said u-shaped support arm relative to said extension arm.

8. The compound bow attachment of claim 7, wherein said locking mechanism comprises a wing nut.

9. The compound bow attachment of claim 8, wherein one of said extension arm and said u-shaped support arm comprises two opposing flanges and the other of said extension arm and said u-shaped support arm comprises a center flange positioned between said two opposing flanges, wherein each of said two opposing flanges and said center flange comprise an opening that align such that a bolt is placed through a first of said opposing flanges, through said center flange, and through a second of said opposing flanges, wherein said wing nut is positioned on said bolt such that tightening of said wing nut tightens said opposing flanges on said center flange to prevent pivotal movement of said u-shaped support arm relative to said extension arm.

10. The compound bow attachment of claim 2, wherein said u-shaped support arm comprises a split ring comprising a gap and configured to attach to said extension arm, wherein said split ring comprises a first post extending outward from a circumference of said split ring, and a second post spaced apart from said first post and extending outward from a circumference of said split ring; and an elastomeric material comprising a length and comprising two spaced apart openings within said length, wherein said two spaced apart openings comprise a first opening and a second opening, wherein said first opening is configured to attach to said first post and said second opening is configured to attach to said second post such that said elastomeric material follows said circumference of said split over said gap and provides tension to said split ring to narrow a width of said gap to tighten said split ring on said extension arm.

11. The compound bow attachment of claim 1, wherein said extension arm comprises an archery bow stabilizer.

12. The compound bow attachment of claim 1, wherein said u-shaped support arm is attached to said extension arm by a clamp.

13. The compound bow attachment of claim 12, wherein said u-shaped support arm is integral with said extension arm.

14. The compound bow attachment of claim 1, wherein said extension arm comprises a threaded end configured for attachment to a receiver for a bow stabilizer.

15. The compound bow attachment of claim 1, wherein said compound bow attachment comprises a weight, wherein said weight comprises a post comprising external threads configured to engage an opening comprising internal threads at said second end of said extension arm, wherein said u-shaped support arm comprises a ring that is configured for through placement of said post such that when said weight is attached to said second end of said extension arm, said u-shaped support arm is attached at said second end of said extension arm.

* * * * *